US012510316B2

(12) United States Patent
Puha

(10) Patent No.: US 12,510,316 B2
(45) Date of Patent: Dec. 30, 2025

(54) BOX MAGAZINE FED FIREARM RECEIVER WITH PINCH TABS

(71) Applicant: Eight Holdings LLC, Coeur D'Alene, ID (US)

(72) Inventor: Teodor Puha, Coeur D'Alene, ID (US)

(73) Assignee: Eight Holdings, LLC, Coeur D'Alene, ID (US)

( * ) Notice: Subject to any disclaimer, the term of this patent is extended or adjusted under 35 U.S.C. 154(b) by 0 days.

(21) Appl. No.: 18/741,682

(22) Filed: Jun. 12, 2024

(65) Prior Publication Data

US 2025/0102252 A1 Mar. 27, 2025

Related U.S. Application Data

(60) Provisional application No. 63/521,695, filed on Jun. 18, 2023, provisional application No. 63/472,583, filed on Jun. 12, 2023.

(51) Int. Cl.

| | |
|---|---|
| ***F41A 9/55*** | (2006.01) |
| ***F41A 3/66*** | (2006.01) |
| ***F41A 9/70*** | (2006.01) |
| *F41C 7/00* | (2006.01) |

(52) U.S. Cl.

CPC ..... *F41A 9/55* (2013.01); *F41A 3/66* (2013.01); *F41A 9/70* (2013.01); *F41C 7/00* (2013.01)

(58) Field of Classification Search

CPC ..... F41A 9/55; F41A 9/70; F41A 3/66

See application file for complete search history.

(56) References Cited

U.S. PATENT DOCUMENTS

| | | | | | |
|---|---|---|---|---|---|
| 2,585,738 | A * | 2/1952 | Chapin | F41A 9/55 | 42/25 |
| 2,870,561 | A * | 1/1959 | Colby | F41A 9/55 | 42/50 |
| 3,276,322 | A * | 10/1966 | Christiansson | F41A 9/55 | 89/45 |
| 3,394,481 | A * | 7/1968 | Orozco | F41A 9/55 | 42/17 |
| 3,516,189 | A * | 6/1970 | Badali | F41A 9/70 | 42/50 |
| 4,787,287 | A * | 11/1988 | Skowasch | F41A 9/58 | 42/23 |
| 4,864,758 | A * | 9/1989 | Crossman | F41A 9/23 | 42/18 |
| 8,839,541 | B1 * | 9/2014 | Karfiol | F41A 9/55 | 42/6 |
| 9,310,159 | B1 * | 4/2016 | Lemoine | F41C 23/12 | |
| 10,151,546 | B2 * | 12/2018 | Baker | F41A 9/65 | |
| 11,306,985 | B2 * | 4/2022 | Bubits | F41A 9/69 | |
| 2008/0245219 | A1 * | 10/2008 | Moucheboeuf | F41A 9/60 | 89/35.02 |

(Continued)

*Primary Examiner* — Joshua E Freeman

(74) *Attorney, Agent, or Firm* — Mark A. Pitchford; Eric B. Fugett; Pitchford Fugett, PLLC

(57) ABSTRACT

A box magazine fed firearm includes pinch tabs in the receiver of the firearm. In one embodiment, the pinch tabs are opposing pieces of spring steel extending upwardly and inwardly from opposing lateral sides of the receiver. In one embodiment, the pinch tabs are sections of flat spring steel bent into an arcuate shape and secured to the receiver by screws. In one embodiment, tension screws are used to adjust an inward bias of each of the pinch tabs.

17 Claims, 9 Drawing Sheets

(56) References Cited

U.S. PATENT DOCUMENTS

| | | | | |
|---|---|---|---|---|
| 2009/0249947 | A1* | 10/2009 | Coiffet | F42B 39/085<br>89/35.02 |
| 2011/0277366 | A1* | 11/2011 | Steffes | F41A 9/65<br>42/50 |
| 2012/0066950 | A1* | 3/2012 | Davidson | F41A 9/69<br>42/50 |
| 2022/0244006 | A1* | 8/2022 | No | F41A 9/70 |
| 2023/0053485 | A1* | 2/2023 | Schoenfeld | F41A 9/67 |
| 2024/0369316 | A1* | 11/2024 | Vitulli | F41A 9/70 |

* cited by examiner

BOX MAGAZINE FED FIREARM RECEIVER WITH PINCH TABS

CROSS-REFERENCE TO RELATED APPLICATIONS

This application claims priority to U.S. Provisional Patent Application No. 63/472,583 entitled "LOWER RECEIVER FOR AR-PATTERN FIREARMS" filed on Jun. 12, 2023. This application claims priority to U.S. Provisional Patent Application No. 63/521,695 entitled "UPPER RECEIVER FOR AR-PATTERN FIREARMS" filed on Jun. 18, 2023.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

FEDERALLY SPONSORED RESEARCH AND DEVELOPMENT

Not Applicable

BACKGROUND OF THE INVENTION

The present invention relates generally to firearms. More particularly, this invention pertains to box magazine fed firearms.

As disclosed in U.S. Pat. No. 10,605,553, retention devices which retain shotgun shells within a magazine until the bolt advances the shell into a feed ramp are known in the art. These prior art retention devices are built into the box magazine. These prior art retention devices are thus fixed, not adjustable, and formed of plastic. Therefore, prior art retention devices are subject to significant wear which can, over time, reduce the functional reliability of the magazine. Additionally, environmental conditions (e.g., extreme temperatures) may change the rigidity of the plastic of the box magazine, and since the retention devices are not adjustable, can result in reduced reliability of the magazine as long as the environment condition persists.

SUMMARY OF THE INVENTION

Aspects of the present invention provide a box magazine fed firearm including pinch tabs in the receiver of the firearm. In one embodiment, the pinch tabs are opposing pieces of spring steel extending upwardly and inwardly from opposing lateral sides of the receiver. In one embodiment, the pinch tabs are sections of flat spring steel bent into an arcuate shape and secured to the receiver by screws. In one embodiment, tension screws are used to adjust an inward bias of each of the pinch tabs.

In one aspect of the present invention, a firearm includes a receiver and a pair of pinch tabs. The receiver is configured to receive a box magazine containing a round of ammunition received the round from the box magazine, and provide the round to a chamber of the firearm. The chamber extends along a longitudinal axis of the firearm. The pair of pinch tabs extend laterally inward from opposing sides of the receiver. The pinch tabs are configured to contact the round and cooperate with rear feed lips of the box magazine to retain the round generally parallel to the longitudinal axis when a bolt of the firearm is in a rear position of the bolt and the box magazine is in the receiver with the round in the box magazine. That is, the pair of pinch tabs limit upward movement of the round while the bolt is in the rear position of the bolt.

In another aspect of the invention, a detachable box magazine for a firearm including a pair of opposing pinch tabs includes a main body, a follower, a floorplate, a follower spring, rear feed lips, a front feed ramp, a rear feed ramp, and a pair of recesses in the main body. The main body is configured to contain a round of ammunition. The follower is configured to support the round of ammunition. The floorplate encloses a bottom end of the main body. The follower spring is configured to extend between the floorplate and the follower to bias the follower and the round of ammunition upward, away from the floorplate. Rear feed lips at a rear of the main body are configured to prevent upward movement of the round when the round is at a rear of the magazine inside the main body of the magazine. The front feed ramp is configured to contact a front end of the round and translate forward motion of the round into upward motion. The rear feed ramp is configured to contact a rear end of the round and translate forward motion of the round into upward motion. The pair of recesses in the main body are forward of the rear feed lips and rearward of the front feed ramp. The pair of recesses is configured to receive the pair of opposing pinch tabs when the box magazine is inserted into the firearm receiver and a bolt of the firearm is in a rear position of the bolt.

BRIEF DESCRIPTION OF DRAWINGS

Reference will now be made in detail to optional embodiments of the invention, examples of which are illustrated in accompanying drawings. Whenever possible, the same reference numbers are used in the drawing and in the description referring to the same or like parts.

DETAILED DESCRIPTION OF THE INVENTION

Figure 1:
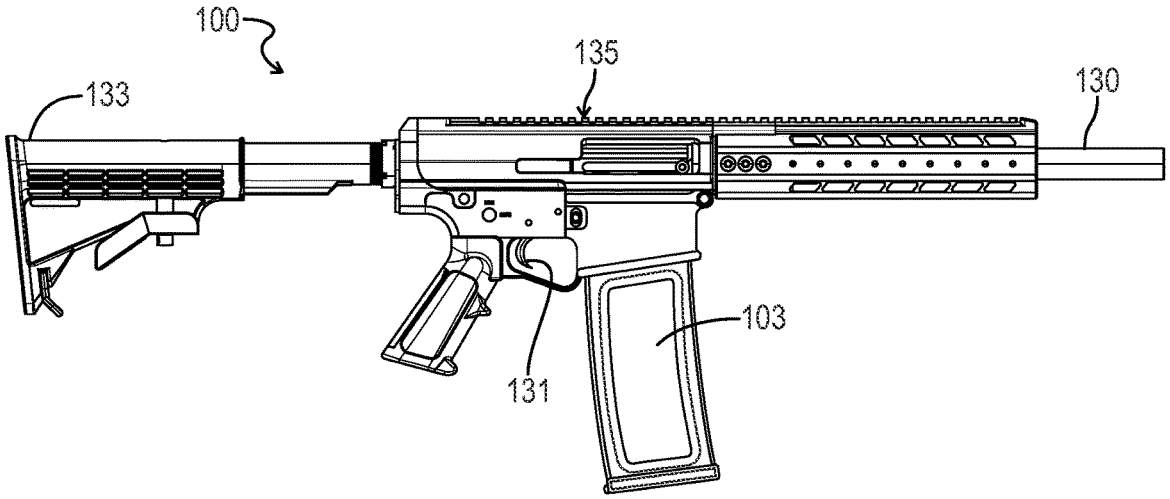
FIG. 1 is a side perspective view of a firearm according to one embodiment of the invention.
Figure 2:
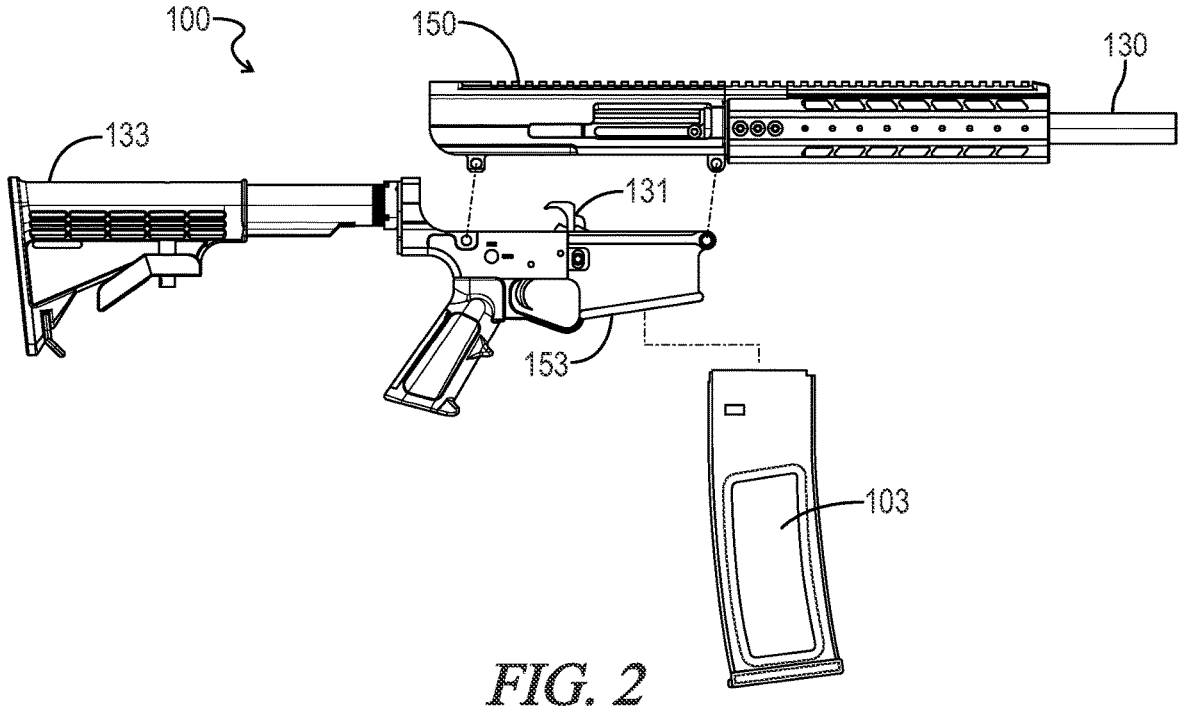
FIG. 2 is an exploded side perspective view of the firearm of FIG. 1.
Figure 3:
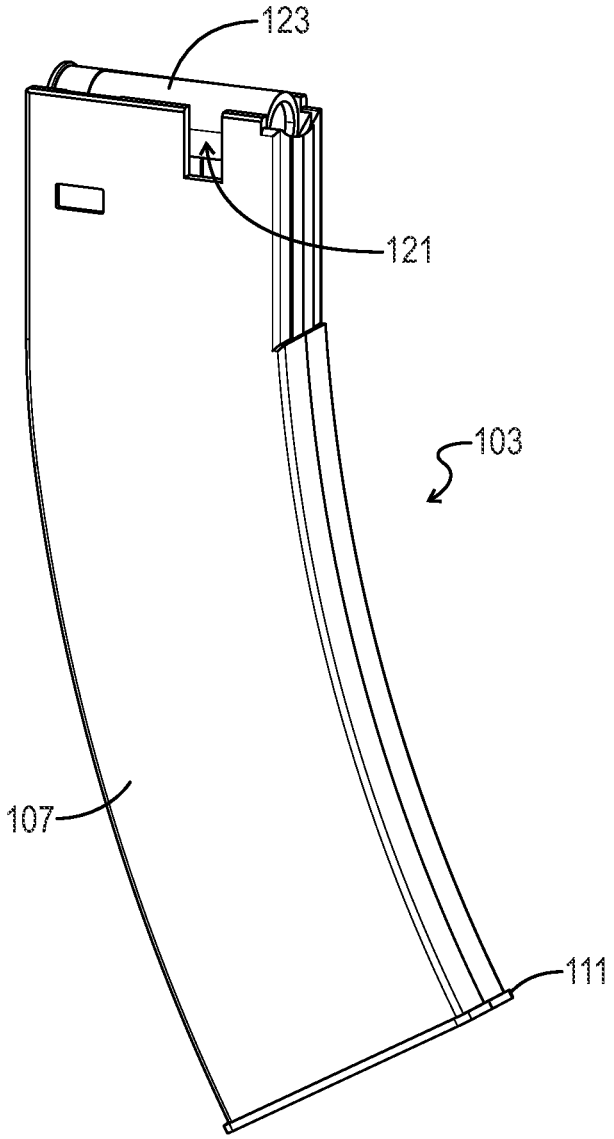
FIG. 3 is an isometric view of a box magazine of the firearm of FIG. 1
Figure 4:
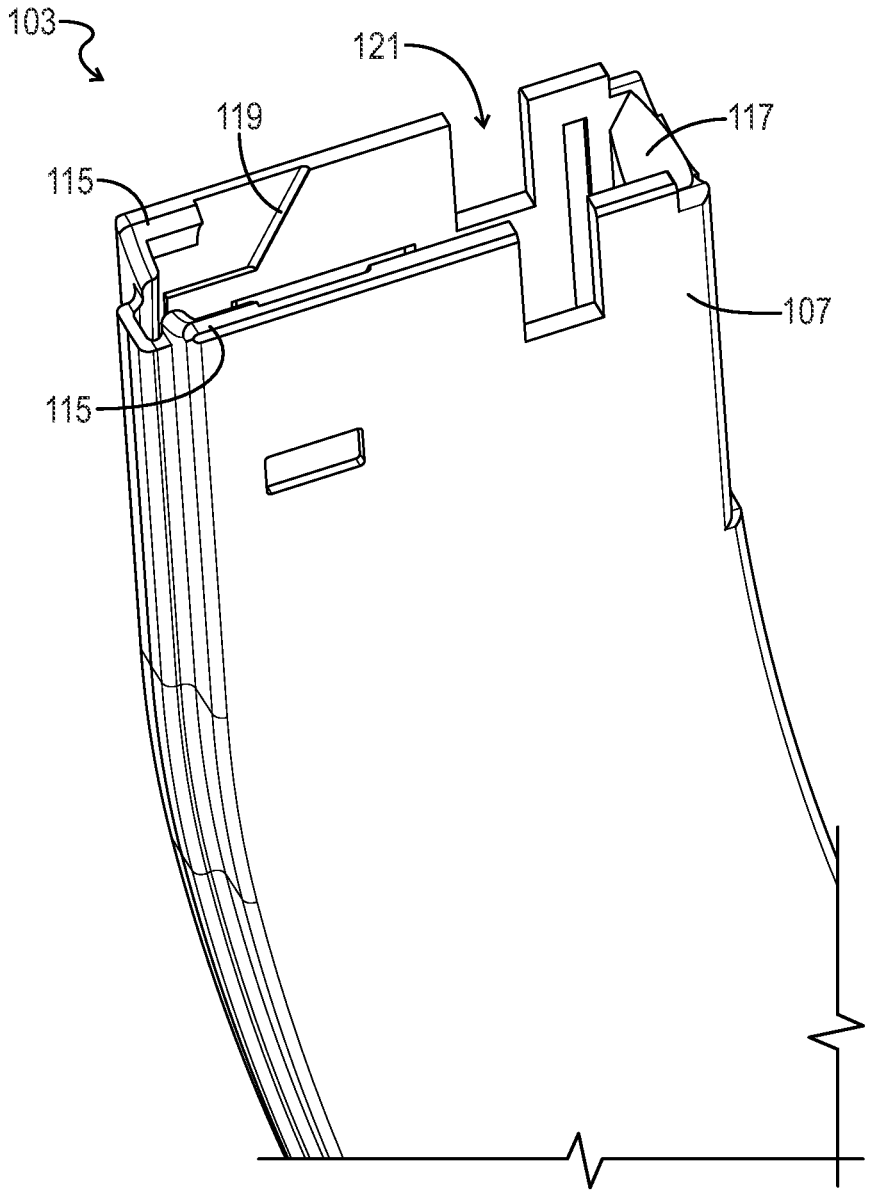
FIG. 4 is an isometric view of the top of the box magazine of FIG. 3.
Figure 5:
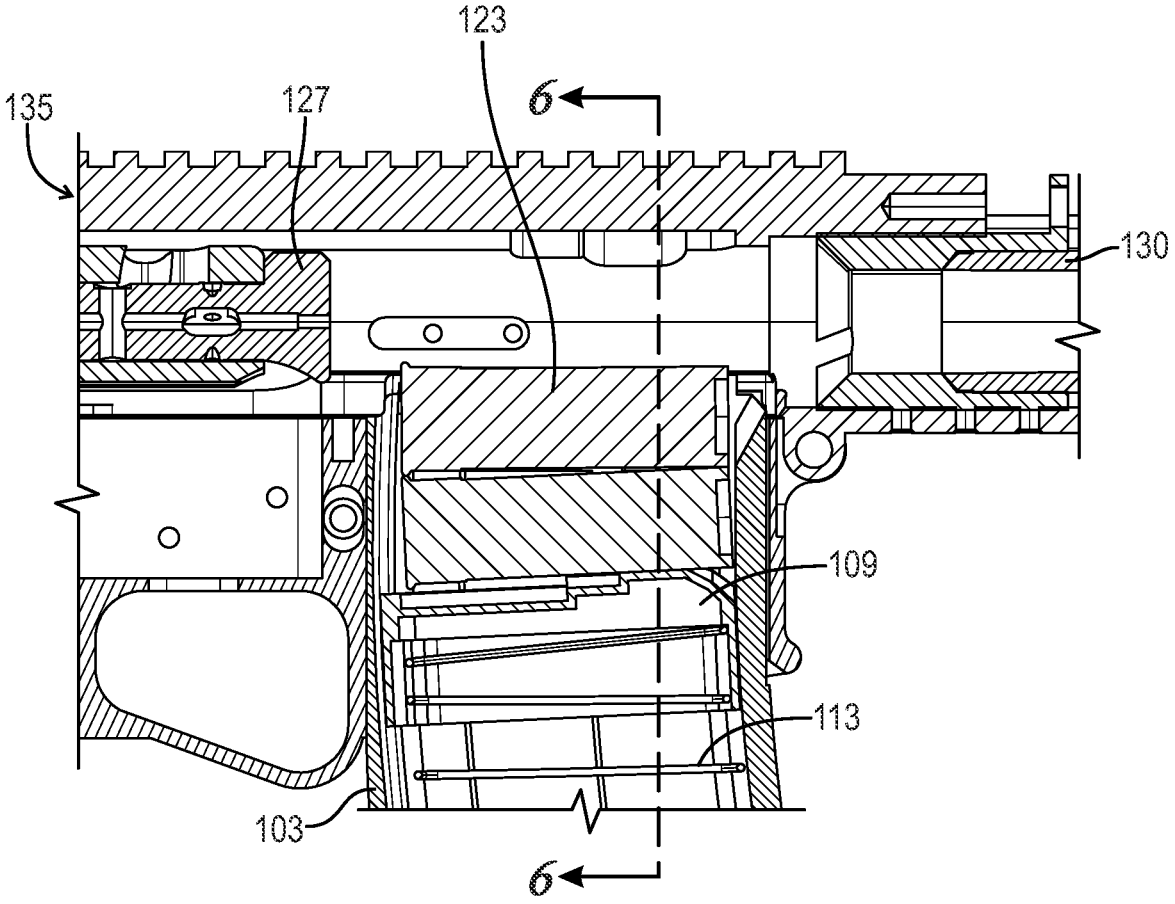
FIG. 5 is a side cutaway view of the firearm of FIG. 1 with the bolt in the rearward position.
Figure 6:
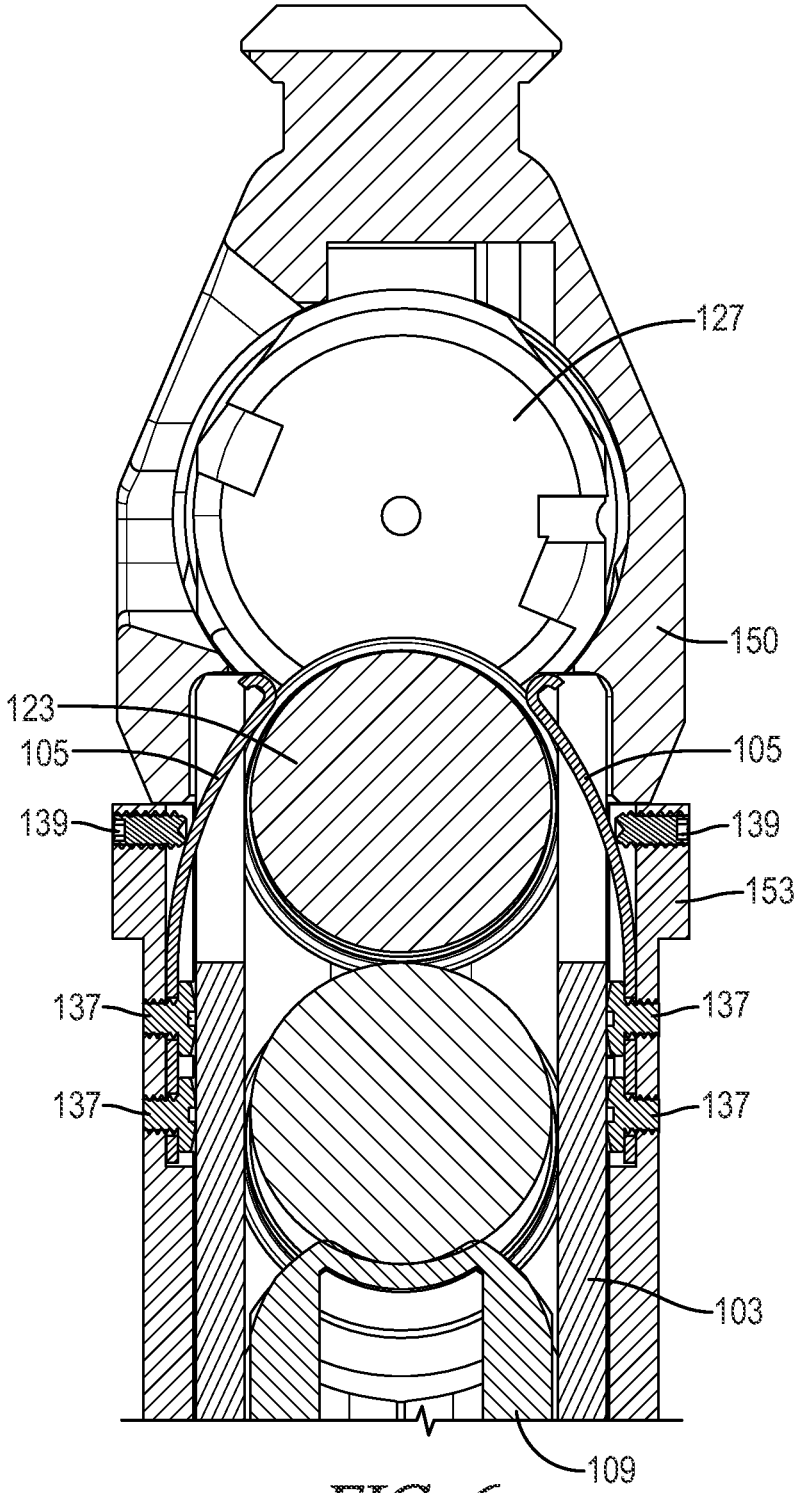
FIG. 6 is a front cutaway view of the firearm of FIG. 1 taken along a pair of opposing pinch tabs of the firearm with the bolt in the rearward position.
Figure 7:
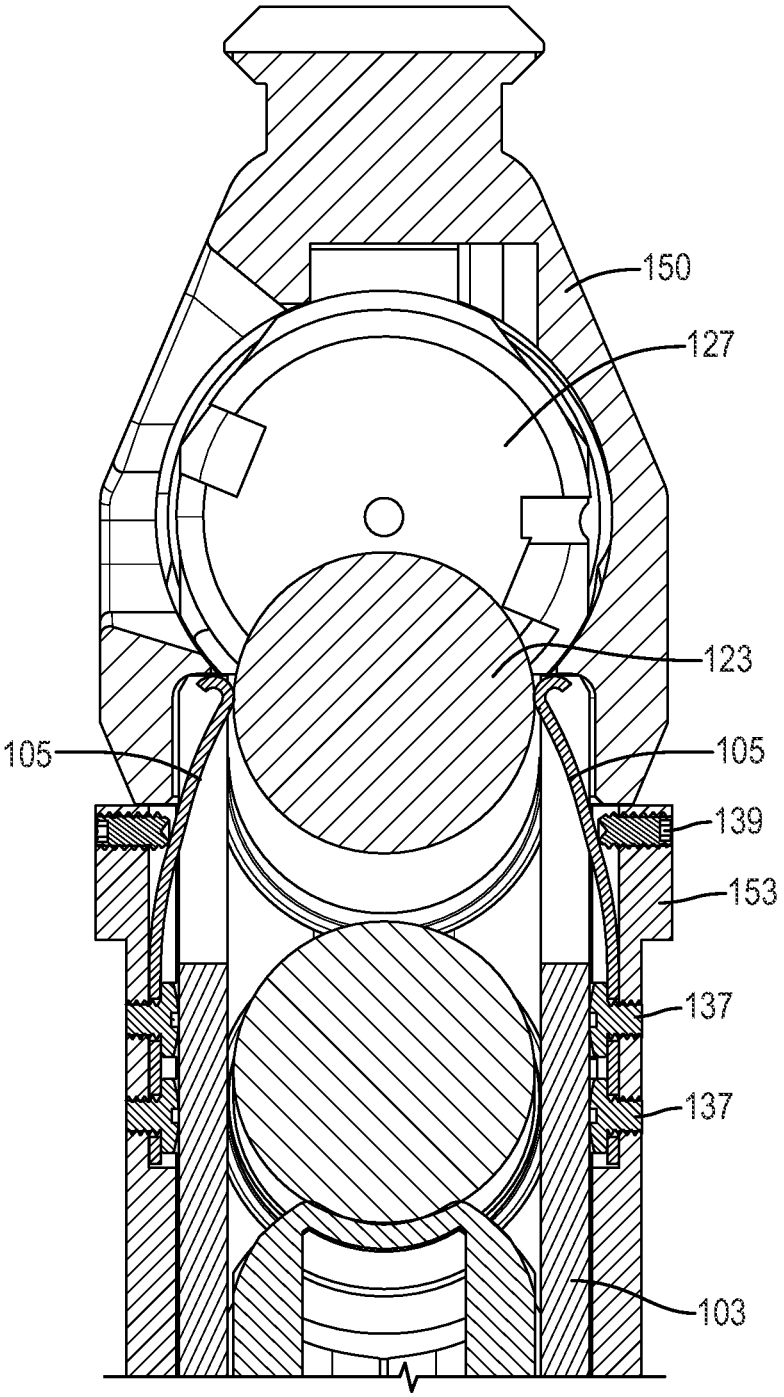
FIG. 7 is a front cutaway view of the firearm of FIG. 1 taken along the pair of opposing pinch tabs of the firearm with the bolt moving the round of ammunition forward in the magazine.

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

To facilitate the understanding of the embodiments described herein, a number of terms are defined below. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims.

As described herein, an upright position is considered to be the position of apparatus components while in proper operation or in a natural resting position as described herein. As used herein, the upright or vertical position of a gun or firearm is when assembled and held by a shooter, ready to shoot (i.e., fire or discharge), with the bore of the barrel of the gun extending generally horizontally or level along a longitudinal axis and the trigger extending generally downward. Vertical, horizontal, above, below, side, top, bottom and other orientation terms are described with respect to this upright position during operation unless otherwise specified. The term "when" is used to specify orientation for relative positions of components, not as a temporal limitation of the claims or apparatus described and claimed herein unless otherwise specified. The terms "above", "below", "over", and "under" mean "having an elevation or vertical height greater or lesser than" and are not intended to imply that one object or component is directly over or under another object or component.

The phrase "in one embodiment," as used herein does not necessarily refer to the same embodiment, although it may. Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without operator input or prompting, whether these features, elements and/or states are included or are to be performed in any particular embodiment.

The terms "coupled" and "connected" mean at least either a direct electrical or mechanical connection between the connected items or an indirect connection through one or more passive or active intermediary devices.

Referring now to FIGS. 1-11, a firearm 100 includes a pair of opposing pinch tabs 105. A detachable box magazine 103 for the firearm 100 includes a main body 107, a follower 109, floorplate 111, a follower spring 113, rear feed lips 115, a front feed ramp 117, rear feed ramp 119, and a pair of recesses in the main body 121. The main body 107 is configured to contain a round 123 of ammunition. In one embodiment, the main body 107 is formed of plastic. The follower 109 is configured to support the round 123. The floorplate 111 encloses a bottom end of the main body 107. The follower spring 113 is configured to extend between the floorplate 111 and the follower 109 to bias the follower 109 and the round of ammunition 123 upward, away from the floorplate 111. The rear feed lips 115 are at a rear of the main body 107. The rear feed lips on 15 or configured to prevent upward movement of the round 123 with around 123 is in the main body 107 and at the rear of the magazine 103. The front feed ramp 117 is configured to contact the front of the round 123 and translate forward motion of the round 123 into upward motion. The rear feed ramp 119 is configured to contact rear of the round 123 and translate forward motion of the round 123 and upward motion. In one embodiment, the rear feed ramp 119 is an indentation or recess formed on the inner wall of the main body 107 extending beneath and forward of the rear feed lips 115. The pair of recesses 121 in the main body 107 of the magazine 103 are forward of the rear feed lips 115 and rearward of the front feed ramp 117. The pair of recesses 121 are configured to receive the pair of opposing pinch tabs 105 when the box magazine 103 is inserted into the firearm 100 and a bolt 127 of the firearm 100 is in a rear position of the bolt 127.

In one embodiment, the firearm 100 includes a receiver 135, barrel 130, a trigger group 131, and a stock 133 or arm brace. The barrel 130 includes a chamber. The trigger group 131 is configured to fire the round 123 of ammunition from the chamber in response to input from a user. The stock 133 extends rearward from the receiver 135. The receiver 135 is configured to receive the box magazine 103 containing the round 123 of ammunition, receive the round 123 from the box magazine 103, and provide the round 123 to the chamber of the firearm 100. The chamber extends along the longitudinal axis of the firearm 100.

Figure 10:
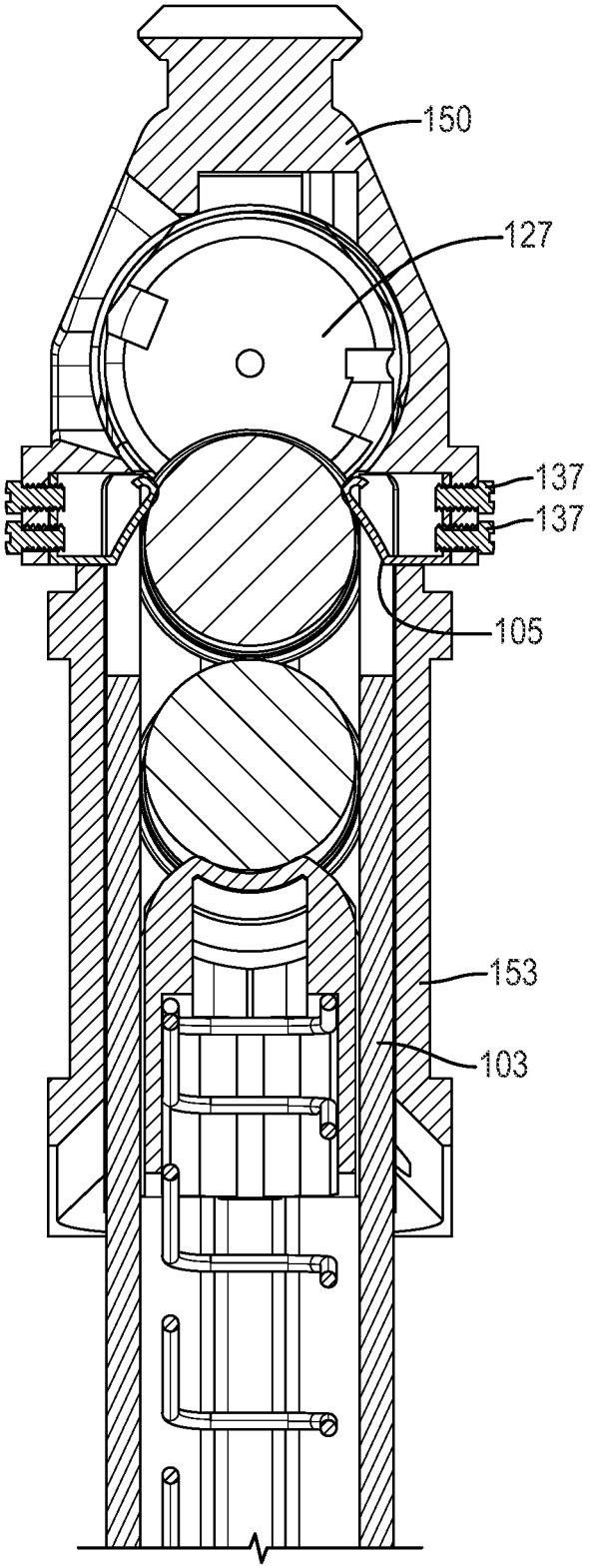
FIG. 10 is a front cutaway view of a firearm having a pair of opposing pinch tabs in an upper receiver of the firearm taken along the pair of opposing pinch tabs.

In one embodiment, the firearm 100 includes a pair of pinch tabs 105 extending laterally inward from opposing sides of the receiver 135. The pinch tabs 105 are configured to contact the round 123 and cooperate with the rear feed lips 115 of the box magazine 103 to retain the round 123 generally parallel to the longitudinal axis when the bolt 127 of the firearm 100 is in the rear position of the bolt and the box magazine 103 is in the receiver 135 with the round 123 in the box magazine 103. In one embodiment, the pair pinch tabs 105 are formed from spring steel. The pinch tabs 105 may also be formed of other materials such as aluminum, mild steel, or plastic. The elongated nature of the pinch tabs 105 reduces wear on the materials, increasing the service life of the pinch tabs 105 over the prior art magazine-based retention devices. In one embodiment, each pin stabbed 1 of 5 of the pair pinch tabs is arcuate, extending upwardly and inwardly from the opposing sides of the receiver 135. In one embodiment, each pinch tab 105 of the pair of pinch tabs is mounted to the receiver 135 via a pair of screws 137 (i.e., pair of mounting screws) at a lower end of each of the pinch tabs 105. In another embodiment, each pinch tab 105 is mounted to the receiver 135 via a pair of rivets or a mechanical interlock (e.g., insertion into a complementary interference fit slot in the receiver 135). In one embodiment, the firearm 100 further includes a pair of tension screws 139. Each tension screw 139 of the pair of tension screws is mounted in an opposing side of the receiver 135 above the lower end of each pinch tab 105 of the pair pinch tabs such that turning the tension screw 139 adjusts inward cant of a corresponding pinch tab 105 of the pair pinch tabs. In one embodiment, each of the pinch tabs 105 has an upper and extending outwardly from a middle section of each pinch tab 105. The middle section of each pinch tab 105 connects the upper end of each pinch tab 105 to the lower end of the pinch tab 105. In one embodiment, the receiver 135 is an AR pattern receiver (e.g., AR-10) having an upper receiver 150 and a lower receiver 153. The pair of pinch tabs 105 are mounted to the lower receiver 153. Referring especially to FIG. 10, in one embodiment, the pair of pinch tabs 105 are mounted to the upper receiver 150. In one embodiment, the receiver 135 includes the upper receiver 150 and the lower receiver 153, and while the lower receiver 153 is an AR-10 pattern lower receiver, the upper receiver 150 is proprietary. In another embodiment, the receiver 135 is a 2 part receiver including the upper receiver 150 and the lower receiver 153, and neither the upper receiver 150 nor the lower receiver 153 are AR-10 pattern parts (i.e., both the upper receiver 150 and the lower receiver 153 are proprietary or based on a different standard). In one embodiment, the firearm 110 is a shotgun, and the round of ammunition 123 is a shotgun shell.

Figure 8:
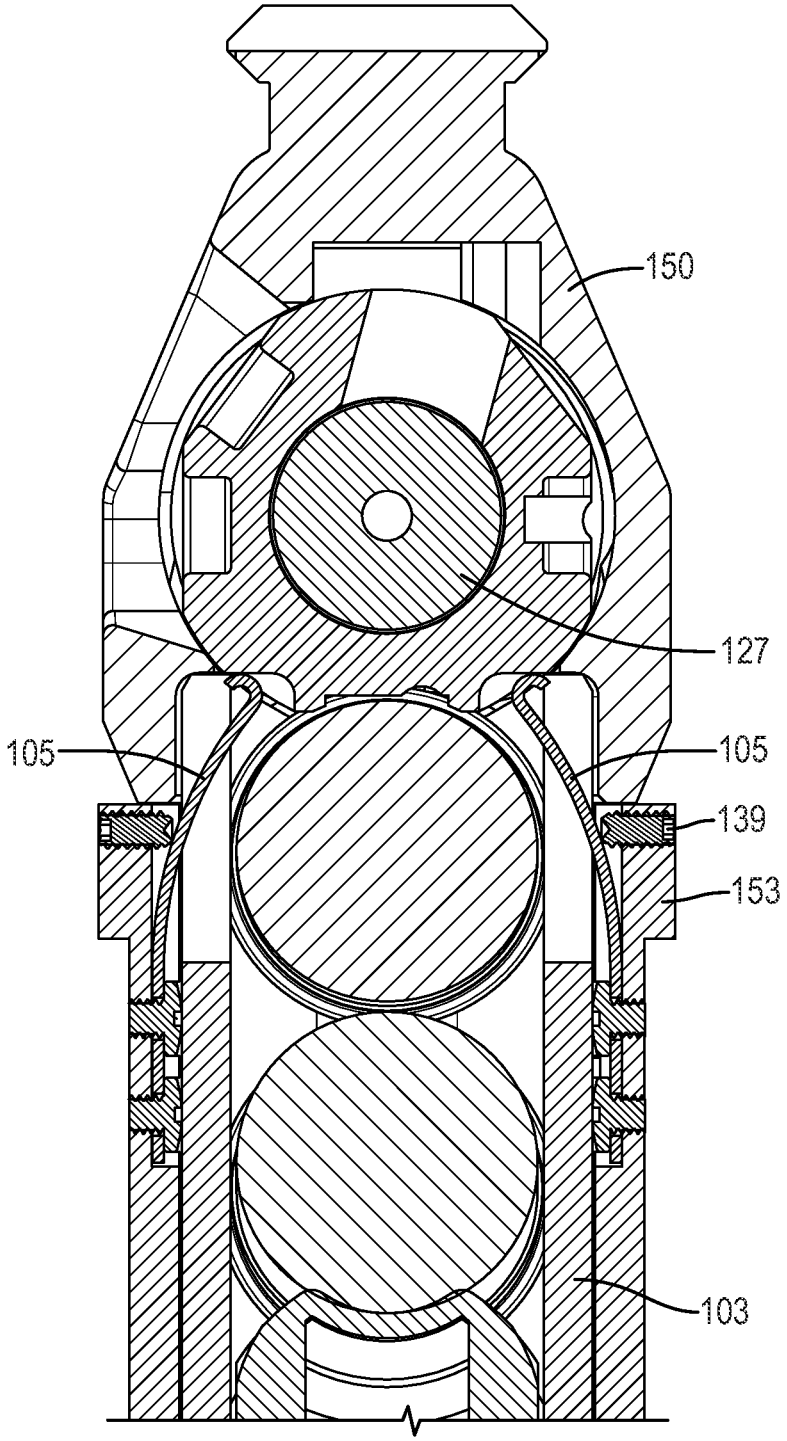
FIG. 8 is a front cutaway view of the firearm of FIG. 1 taken along the pair of opposing pinch tabs of the firearm with the bolt in a forward position.
Figure 9:
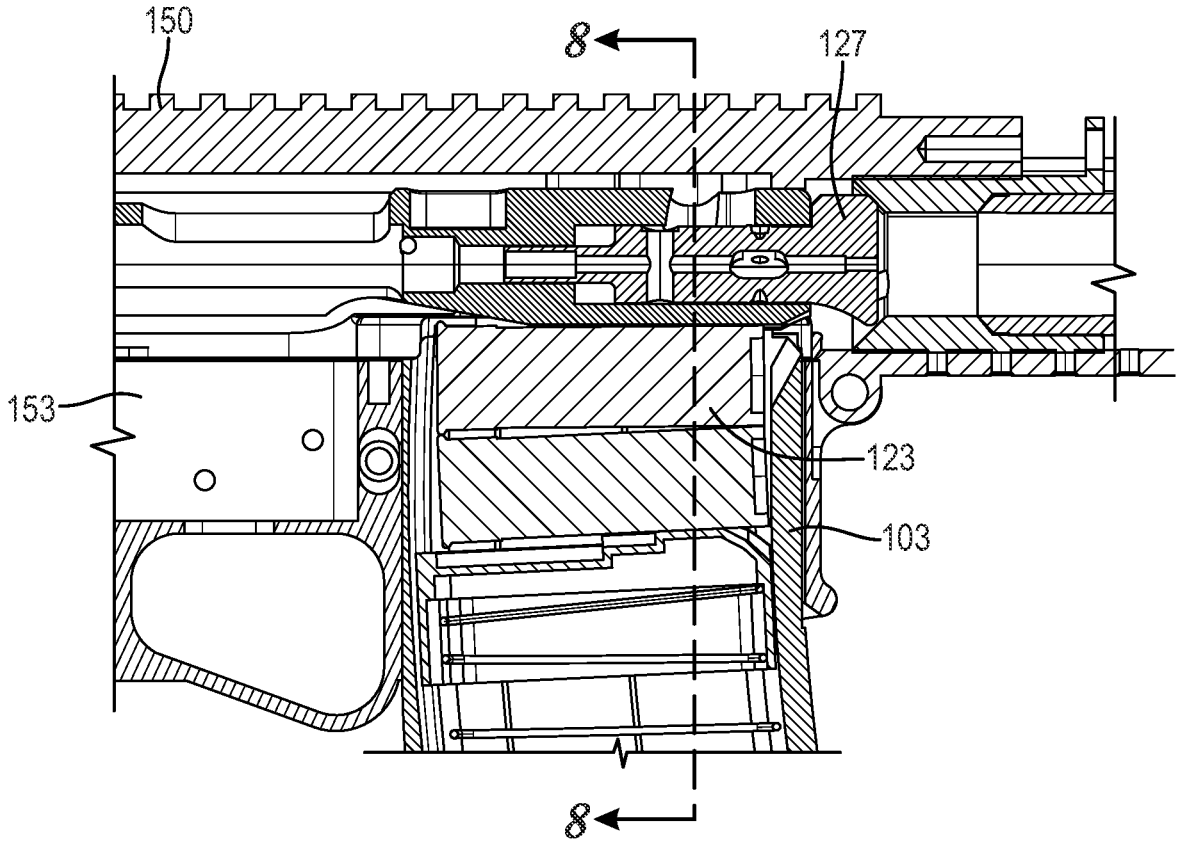
FIG. 9 is a front cutaway view of the firearm of FIG. 1 taken along the pair of opposing pinch tabs of the firearm with the bolt in a forward position.

Referring to FIGS. 5-9, these figures show, in order, the bolt 127 moving from the rear position (FIGS. 5 and 6) to the forward position (FIGS. 8 and 9). As the bolt 127 moves from the rear position to the forward position, the bolt pushes a rear end of the round 123 forward of the rear feed lips 115 of the box magazine 103 such that only the pair of pinch tabs 105 are exerting downward force on the round 123. When the rear end (e.g., rim) of the round 123 moves forward of the rear feed lips 115, a base (e.g., rim) of the round 123 engages the rear feed ramp 119 of the box magazine 103 and the front end of the round 123 engages the front feed ramp 119 of the box magazine 103 such that the round 123 is forced upward by the front and rear feed ramps 117, 119 through the pair of pinch tabs 105. The round 123 tilts less than 30° relative to the longitudinal axis (see e.g., FIG. 7 where the round 123 is slightly higher in at the front than at the rear) as the round 123 moves upward and forward toward the chamber of the firearm 100. In one embodiment, the pair pinch tabs 105 are configured to flex outward away from one another as the round 123 passes between the pair pinch tabs 105 when the bolt 127 and front and rear feed ramps 117, 119 of the box magazine 103 cooperate to force the round 123 forward and upward. In one embodiment, the box magazine 103 has a pair of opposing recesses 121 corresponding to the pair pinch tabs 105 such that the pair pinch tabs can extend into the pair of opposing recesses 121 when the firearm 100 is cycled or when the bolt 127 is in the forward position such that bolt carrier is providing downward force on the round 123 (see e.g., FIGS. 8 and 9).

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific procedures described herein. Such equivalents are considered to be within the scope of this invention and are covered by the claims.

All of the compositions and/or methods disclosed and claimed herein may be made and/or executed without undue experimentation in light of the present disclosure. While the compositions and methods of this invention have been described in terms of the embodiments included herein, it will be apparent to those of ordinary skill in the art that variations may be applied to the compositions and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims.

Thus, although there have been described particular embodiments of the present invention, it is not intended that such references be construed as limitations upon the scope of this invention except as set forth in the following claims.

What is claimed is:

1. A firearm comprising:

a receiver configured to receive a box magazine containing a round of ammunition, receive the round from the box magazine, and provide the round to a chamber of the firearm, wherein the chamber extends along a longitudinal axis of the firearm; and a pair of pinch tabs extending laterally inward from opposing sides of the receiver, said pinch tabs configured to contact the round and cooperate with rear feed lips of the box magazine to retain the round generally parallel to the longitudinal axis when a bolt of the firearm is in a rear position of the bolt and the box magazine is in the receiver with the round in the box magazine, wherein:

as the bolt moves from the rear position of the bolt to a forward position of the bolt, the bolt pushes a rear end of the round forward of the rear feed lips of the box magazine such that only the pair of pinch tabs are exerting downward force on the round.

2. The firearm of claim 1, wherein:

the pair of pinch tabs are formed of spring steel.

3. The firearm of claim 1, wherein:

the pair of pinch tabs are formed of spring steel; and each pinch tab of the pair of pinch tabs is arcuate, extending upwardly and inwardly from the opposing sides of the receiver.

4. The firearm of claim 1, wherein:

the pair of pinch tabs are formed of spring steel;

each pinch tab of the pair of pinch tabs is arcuate, extending upwardly and inwardly from the opposing sides of the receiver; and each pinch tab of the pair of pinch tabs is mounted to the receiver via a pair of screws.

5. The firearm of claim 1, wherein:

the pair of pinch tabs are formed of spring steel;

each pinch tab of the pair of pinch tabs is arcuate, extending upwardly and inwardly from the opposing sides of the receiver;

each pinch tab of the pair of pinch tabs is mounted to the receiver at a lower end of each of the pinch tabs of the pair of pinch tabs; and the firearm further comprises a pair of tension screws, each tension screw of the pair of tension screws mounted in an opposing side of the receiver above the lower end of each pinch tab of the pair of pinch tabs such that turning a tension screw of the pair of tension screws adjusts inward cant of a corresponding pinch tab of the pair of pinch tabs.

6. The firearm of claim 1, wherein:

the pair of pinch tabs are formed of spring steel;

each pinch tab of the pair of pinch tabs is arcuate, extending upwardly and inwardly from the opposing sides of the receiver; and each of the pinch tabs has an upper end extending outwardly from a middle section of each pinch tab, said middle section of each pinch tab connecting the upper end of each pinch tab to a lower end of each pinch tab.

7. The firearm of claim 1, wherein:

the receiver comprises an upper receiver and a lower receiver; and the pair of pinch tabs are mounted to the upper receiver.

8. The firearm of claim 1, wherein:

the receiver comprises an upper receiver and a lower receiver; and the pair of pinch tabs are mounted to the lower receiver.

9. The firearm of claim 1, wherein:

when the rear end of the round moves forward of the rear feed lips, a base of the round engages a rear feed ramp of the box magazine and a front end of the round engages a front feed ramp of the box magazine such that the round is forced upward by the front and rear feed ramps through the pair of pinch tabs, and the round tilts less than 30 degrees relative to the longitudinal axis as the round moves upward and forward toward the chamber of the firearm.

10. The firearm of claim 1, wherein:

when the rear end of the round moves forward of the rear feed lips, a base of the round engages a rear feed ramp of the box magazine and a front end of the round engages a front feed ramp of the box magazine such that the round is forced upward by the front and rear feed ramps through the pair of pinch tabs, and the round tilts less than 30 degrees relative to the longitudinal axis as the round moves upward and forward toward the chamber of the firearm; and the pair of pinch tabs are configured to flex outward away from one another as the round passes between the pair of pinch tabs when the bolt and front and rear feed ramps of the box magazine cooperate to force the round forward and upward.

11. The firearm of claim 1, wherein:

the firearm further comprises the box magazine; and the box magazine is a detachable box magazine.

12. The firearm of claim 1, wherein:

the firearm further comprises the box magazine;

the box magazine is a detachable box magazine; and the box magazine has a pair of opposing recesses corresponding to the pair of pinch tabs such that the pair of pinch tabs can extends into the pair of opposing recesses when the bolt is in a forward position of the bolt.

13. The firearm of claim 1, wherein:

the firearm is a shotgun; and the round of ammunition is a shotgun shell.

14. The firearm of claim 1, wherein:

the firearm further comprises a barrel comprising the chamber;

the firearm further comprises a trigger group configured to fire the round of ammunition in the chamber in response to receiving input from a user of the firearm; and the firearm further comprise a stock or arm brace extending rearward from the receiver.

15. A detachable box magazine for a firearm comprising a pair of opposing pinch tabs, said box magazine comprising:

a main body configured to contain a round of ammunition;

a follower configured to support the round of ammunition;

a floor plate enclosing a bottom end of the main body;

a follower spring configured to extend between the floor plate and the follower to bias the follower and the round of ammunition upward, away from the floor plate;

rear feed lips at a rear of the main body, said rear feed lips configured to prevent upward movement of the round when the round is in the main body and at the rear of the main body;

a front feed ramp configured to contact a front of the round and translate forward motion of the round into upward motion;

a rear feed ramp configured to contact a rear of the round and translate forward motion of the round into upward motion; and a pair of recesses in the main body forward of the rear feed lips and rearward of the front feed ramp, said pair of recesses configured to receive the pair of opposing pinch tabs when the box magazine is inserted into the firearm and a bolt of the firearm is in a rear position of the bolt.

16. A firearm comprising:

a detachable box magazine comprising:

a main body configured to contain a round of ammunition;

a follower configured to support the round of ammunition;

a floor plate enclosing a bottom end of the main body;

a follower spring configured to extend between the floor plate and the follower to bias the follower and the round of ammunition upward, away from the floor plate;

rear feed lips at a rear of the main body, said rear feed lips configured to prevent upward movement of the round when the round is in the main body and at the rear of the main body;

a front feed ramp configured to contact a front of the round and translate forward motion of the round into upward motion;

a rear feed ramp configured to contact a rear of the round and translate forward motion of the round into upward motion;

a pair of recesses in the main body forward of the rear feed lips and rearward of the front feed ramp;

a receiver configured to receive the box magazine containing the round of ammunition, receive the round from the box magazine, and provide the round to a chamber of the firearm, wherein the chamber extends along a longitudinal axis of the firearm; and a pair of pinch tabs extending laterally inward from opposing sides of the receiver, said pinch tabs configured to contact the round and cooperate with rear feed lips of the box magazine to retain the round generally parallel to the longitudinal axis when a bolt of the firearm is in a rear position of the bolt and the box magazine is in the receiver with the round in the box magazine, wherein:

the pair of recesses in the main body of the box magazine are configured to receive the pair of opposing pinch tabs when the box magazine is inserted into the firearm and the bolt is in the rear position of the bolt.

17. The firearm of claim 16, wherein: the firearm further comprises a barrel comprising the chamber; the firearm further comprises a trigger group configured to fire the round in response to input from a user; and the firearm further comprises a stock extending rearward from the receiver.

* * * * *